US005428983A

United States Patent [19]

Liu

[11] Patent Number: 5,428,983

[45] Date of Patent: * Jul. 4, 1995

[54] TERMINAL PLIERS

[76] Inventor: Lien-Huang Liu, No. 17, Alley 166, Lane 68, Sua-Yuan Rd., Feng-Yuan City, Taichung Hsien, Taiwan

[ * ] Notice: The portion of the term of this patent subsequent to Jan. 11, 2011 has been disclaimed.

[21] Appl. No.: 185,021

[22] Filed: Jan. 24, 1994

[51] Int. Cl.[6] ..... H01R 43/042

[52] U.S. Cl. ..... 72/410; 72/461; 29/751

[58] Field of Search ..... 72/461, 410, 409, 36; 29/751, 753

[56] References Cited

U.S. PATENT DOCUMENTS

| | | | |
|---|---|---|---|
| 3,260,087 | 7/1966 | Guarino | 72/36 |
| 3,618,349 | 11/1971 | Roch | 72/36 |
| 3,673,848 | 7/1972 | Filia | 72/410 |
| 3,826,119 | 7/1974 | Marotto | 72/461 |
| 4,055,070 | 10/1977 | Wingate | 72/461 |
| 5,277,051 | 1/1994 | Liu | 72/461 |

FOREIGN PATENT DOCUMENTS 585508 2/1947 United Kingdom ..... 72/410

OTHER PUBLICATIONS

Catalog B-12 from The Cincinnati Shaper Company, Dec. 28, 1959, pp. 30 and 31, 72-461.

*Primary Examiner*—Daniel C. Crane

*Attorney, Agent, or Firm*—Browdy and Neimark

[57] ABSTRACT

An improved terminal pliers comprises a first clamping portion and a second clamping portion provided with at least two receiving slots and a terminal locating device mounted thereon. The terminal locating device comprises a base provided with a sliding block movable freely in a direction parallel to a side of the terminal pliers. The sliding block is provided with a stopping member movable in a direction perpendicular to the side of the terminal pliers. The stopping member can be moved freely to an appropriate position so as to locate a terminal intended to be clamped by holding firmly the tail end of the terminal in one of the receiving slots of the second clamping portion.

6 Claims, 2 Drawing Sheets

TERMINAL PLIERS

FIELD OF THE INVENTION

The present invention relates generally to a terminal pliers, and more particularly to a terminal pliers having a locating means for locating a terminal in such a manner that the locating means can be moved over a predetermined portion of the terminal along X, Y and Z axes which are perpendicular to one another.

BACKGROUND OF THE INVENTION

The British Patent Number 585,508 discloses a terminal pliers provided with a terminal locating device which comprises a base and a sliding member capable of moving back and forth on the base. The moving direction of the sliding member is perpendicular to the side of the terminal pliers so as to adjust the distance between the sliding member and the side of the terminal pliers. The U.S. Pat. No. 3,673,848 discloses a terminal locating device which comprises a base and two elastic pieces fastened to the base. As a result, one end of a terminal can be held between the two elastic pieces. The locating device is provided with a retaining piece capable of being moved upwards and downwards along the side of the terminal pliers so as to hold securely one end of the terminal. The terminal locating devices disclosed in the above-mentioned patent documents have one thing in common in that both terminal locating devices are applicable only to a terminal pliers having only one serrated jaw, and that both terminal locating devices can be used to make only the unidirectional adjustment.

SUMMARY OF THE INVENTION

It is therefore the primary objective of the present invention to provide an improved terminal pliers with a terminal locating device capable of moving along three axial directions perpendicular to one another.

The foregoing objective of the present invention is attained by the improved terminal pliers having a first clamping portion, a second clamping portion, and a terminal locating device mounted on the second clamping portion. The terminal locating device is composed of a base fastened securely to the side of the terminal pliers, a sliding block mounted on the base, and a stopping member mounted on the sliding block and provided with a resisting surface. The sliding block, the stopping member and the base are movable freely and respectively on the first, the second and third tracks, which are axially perpendicular to one another. The position of the resisting surface in relation to the side of the terminal plier can be therefore adjusted at will in the three axial directions of X, Y and Z which are perpendicular to one another, thereby permitting the tail end of a terminal to be held securely in the receiving slot of the second clamping portion.

DETAILED DESCRIPTION OF THE INVENTION

Figure 1:
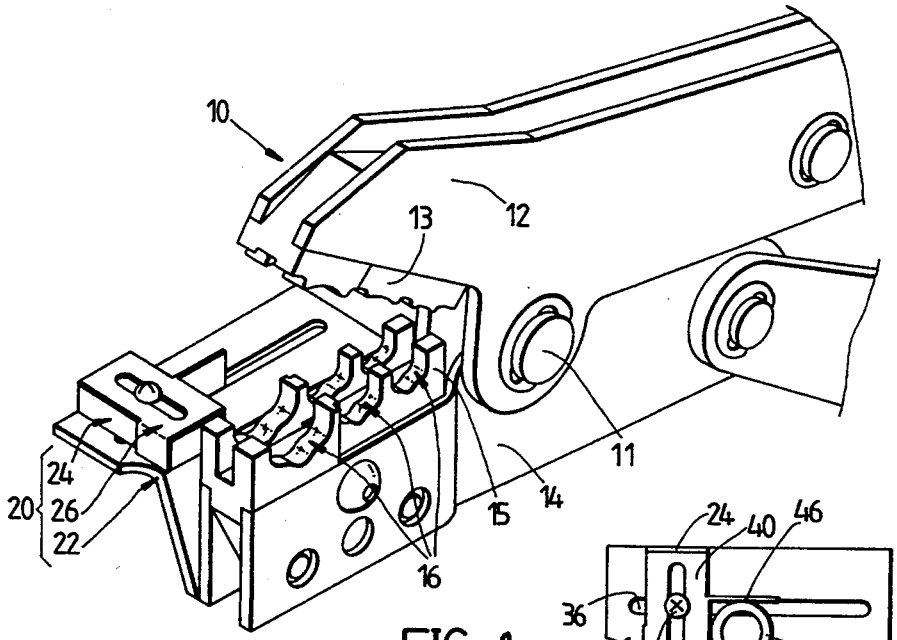
FIG. 1 shows a perspective view of a preferred embodiment of the present invention.
Figure 3:
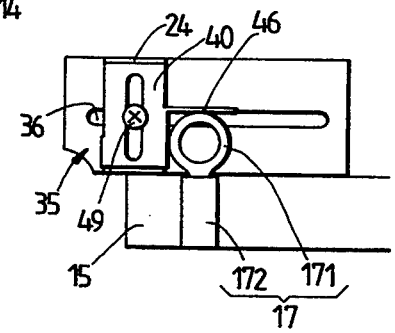
FIG. 3 shows a top plan view of a terminal locating device of the preferred embodiment of the present invention.
Figure 2:
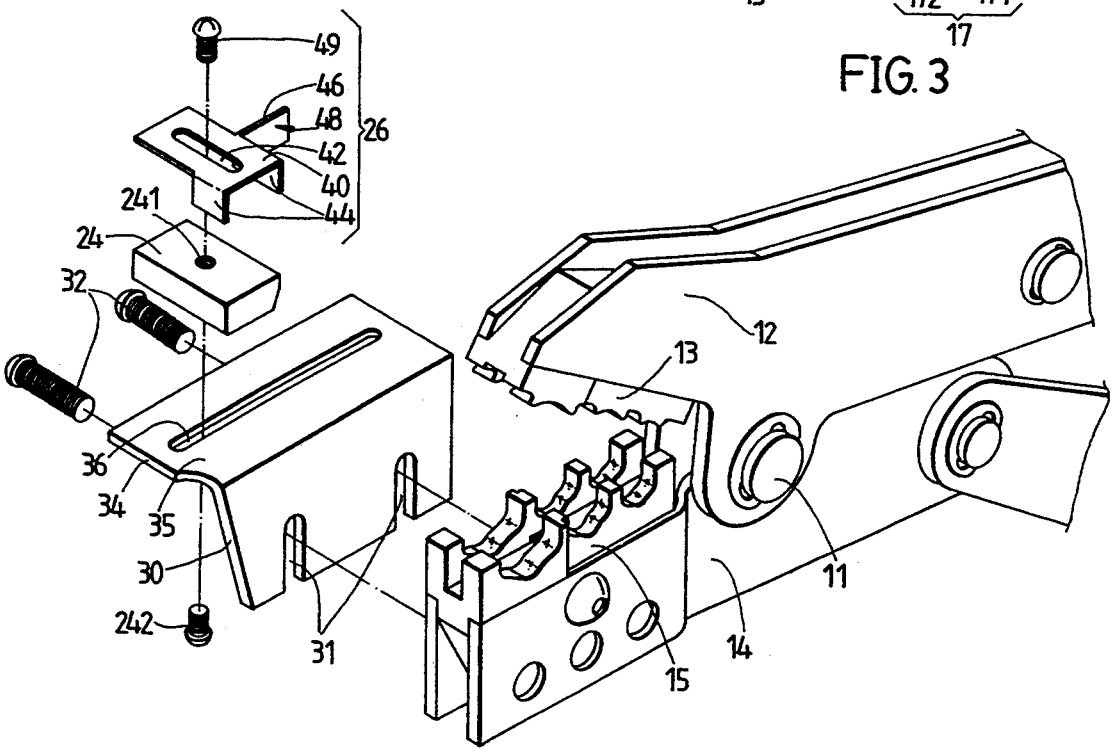
FIG. 2 shows an exploded view of the preferred embodiment of the present invention.

Referring to FIGS. 1–3, a terminal pliers 10 embodied in the present invention is shown to comprise a shaft 11 for pivoting a first clamping portion 12 and a second clamping portion 14, and a terminal locating device 20.

The first and the second clamping portions 12 and 14 are provided respectively with a first jaw 13 and a second jaw 15 which are opposite to each other. The second jaw 15 is provided with three receiving slots 16, in one of which a terminal 17 is received such that the tail end of the terminal 17 is placed beyond the boundary of the second clamping portion 14.

The terminal locating device 20 comprises a base 22, a sliding block 24, and a stopping member 26.

The base 22 is made integrally by punching and pressing and provided with a fastening portion 30 attachable to the side wall of the second clamping portion 14, and with a receiving portion 34 of an appropriate width and extending outwards in a curved path from the top of the fastening portion 30. Disposed in the fastening portion 30 are two long slots 31 extending uprightly from the bottom edge thereof. The receiving portion 34 has a receiving surface 35 normal to the side wall of the second clamping portion 14 and further has a first long through hole 36. In combination, the base 22 is fastened securely to the second clamping portion 14 by means of two first screws 32, which are put through respectively the two long slots 31. The receiving portion 34 can be adjusted upwards or downwards.

The sliding block 24 of rectangular construction is disposed on the receiving surface 35 and provided with a threaded hole 241. In combination, a second screw 242 is put through the long through hole 36 so as to engage the lower end of the threaded hole 241. As the sliding block 24 is moved along the longitudinal axis of the first long through hole 36 to arrive at an appropriate location, the second screw 242 is tightened up.

The stopping member 26 is made integrally by punching and pressing and is composed of a body 40, a second long through hole 42 having a longitudinal axis perpendicular to the side wall of the second clamping portion 14, two flaps 44 of an appropriate width and extending downwards respectively from two side edges of the body 40, and a baffle 46 of an appropriate length and extending in a direction perpendicular to the longitudinal axis of the second long through hole 42. The baffle 46 has a resisting surface 48 opposite and parallel to the side wall of the second clamping portion 14. In combination, the body 40 is mounted on the sliding block 24 such that the second long through hole 42 and the threaded hole 241 are opposite to each other. The stopping member 26 is located appropriately and then fastened securely by means of a third screw 49.

The cooperating efforts of the component parts described above enable the base 22 to move in the direction of the longitudinal axis of the long slots 31 so as to adjust the distance between the receiving surface and the bottom of each of the reveiving slots 16. The sliding block 24 can be caused to move along the first long through hole 36 to the corresponding receiving slot 16. The stopping member 26 can be caused to move along the second long through hole 42 so as to adjust the distance between the resisting surface 48 and the side of the terminal pliers 10. As a result, terminals 17 of various widths and diameters can be placed in the receiving slots 16 having the corresponding widths and diameters, with the tail ends 171 of the terminals 17 being placed outside the terminal pliers 10 and on the receiving surface 35. According to the present invention, the terminal 17 of any dimension can be always located securely such that the tail 171 of the terminal 17 is resisted by the resisting surface 48 and that the head 172 of the terminal 17 is located precisely at the clamping positions of the first jaw 13 and the second jaw 15.

Figure 4:
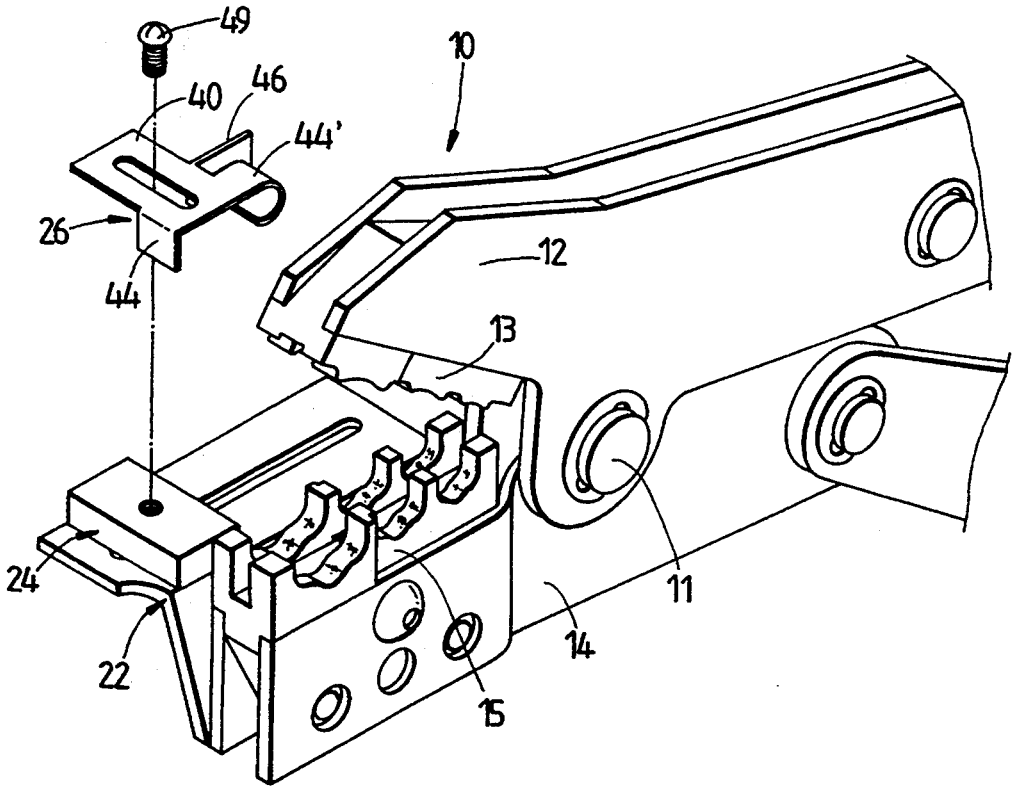
FIG. 4 shows an exploded view of another preferred embodiment of the present invention.

As shown in FIG. 4, the body 40 of the stopping member 26 is provided with a curved flap 44' adjacent to the baffle 46 so as to form a receiving space having an opening facing the side of the terminal plier 30 and to permit the end of the terminal 17 extending outside the terminal pliers 30 to be placed in the receiving space.

Figure 5:
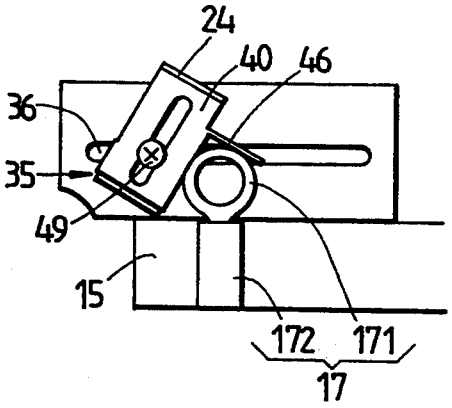
FIG. 5 shows a top plan view of the sliding block which has been turned for an angle of 45 degrees, according to the present invention.

As shown in FIG. 5 in conjunction with FIGS. 2 and 4, the second screw 242 may be used as an axis on which the sliding block 24 and the stopping member 26 are turned for an angle of 45 degrees so as to form a V-shaped opening which faces the side of the terminal pliers 10 and which is located between the baffle 46 and a flap 44. As a result, the terminal 17 can be held more securely in the opening.

What is claimed is:

1. An improved terminal pliers comprising a first clamping portion and a second clamping portion, which are opposite to each other, with said second clamping portion being provided with a terminal locating device and at least two receiving slots opposite in location to a predetermined portion of said first clamping portion; wherein said terminal locating device comprises: a base mounted on a side of said second clamping portion and provided with a first track parallel to said side of said second clamping portion; a stopping member mounted on said base such that said stopping member can be moved back and forth on said first track, said stopping member having thereon a second track perpendicular to said first track; a baffle of a predetermined length and extending in a predetermined direction from said stopping member and having a resisting surface facing said side of said second clamping portion; and a third track disposed on said base such that said third track is perpendicular to said first track and said second track; and wherein said resisting surface can be caused to move freely on said base with said stopping member in X, Y and Z axial directions which are perpendicular to one another, thereby allowing a relative position between said side of said second clamping portion and resisting surface to be adjusted wherein said terminal locating device comprises a sliding block mounted on said base such that said sliding block is movable in the direction of a longitudinal axis of said first track; and wherein said stopping member is mounted on said sliding block such that stopping member is movable in the direction of a longitudinal axis of said second track.

2. The improved terminal pliers of claim 1 wherein said stopping member is made integrally by punching and pressing and has a body; wherein said baffle of a predetermined length is bent at a predetermined angle from a side of said body of said stopping member; and wherein said second track is in itself a long through hole disposed in said body of said stopping member.

3. The improved terminal pliers of claim 1 wherein said base has a fastening portion capable of being moved to make contact with said side of said second clamping portion, said base further having a receiving portion provided with a receiving surface facing upwards and perpendicular to said side of said second clamping portion.

4. The improved terminal pliers of claim 3 wherein said first track is disposed in said receiving portion of said base in the form of a long through hole.

5. The improved terminal pliers of claim 3 wherein said third track is a long hole of a predetermined length and extending uprightly from a lower edge of said fastening portion of said base.

6. The improved terminal pliers of claim 2 wherein said body has a curved side adjacent to said baffle and forming a receiving portion having an opening facing a side of said terminal pliers.

* * * * *